United States Patent [19]

Urban

[11] Patent Number: 4,630,626

[45] Date of Patent: Dec. 23, 1986

[54] CRUTCH TIP CONSTRUCTION

[75] Inventor: Ted. F. Urban, Oshkosh, Wis.

© [73] Assignee: Lamico, Inc., Oshkosh, Wis.

[21] Appl. No.: 700,277

[22] Filed: Feb. 11, 1985

[51] Int. Cl.[4] ..... A45B 9/04

[52] U.S. Cl. ..... 135/84; 135/86

[58] Field of Search ..... 135/77, 86, 84, 68, 135/82, 70, 78, 79, 80, 81, 82, 83

[56] References Cited

U.S. PATENT DOCUMENTS

| | | | |
|---|---|---|---|
| D. 170,437 | 9/1953 | Wood | 135/68 X |
| 624,207 | 5/1899 | Hawley, Jr. | 135/84 |
| 679,468 | 7/1901 | Pratt | 135/84 |
| 1,406,453 | 2/1922 | Fanning | 135/82 |
| 1,753,065 | 4/1930 | Payne | 135/82 |
| 2,376,282 | 5/1945 | Schroeder | 135/81 |
| 3,741,226 | 6/1973 | Urban | 135/84 |
| 4,253,478 | 3/1981 | Husa | 135/68 |

FOREIGN PATENT DOCUMENTS

| | | | |
|---|---|---|---|
| 115731 | 5/1918 | United Kingdom | 135/68 |
| 149019 | 8/1920 | United Kingdom | 135/86 |
| 937601 | 9/1963 | United Kingdom | 135/86 |

*Primary Examiner*—Robert A. Hafer
*Assistant Examiner*—Arnold W. Kramer
*Attorney, Agent, or Firm*—Andrus, Sceales, Starke & Sawall

[57] ABSTRACT

An improved crutch tip construction. The crutch tip is formed of a resilient material and has an upper tubular stem portion formed with an axial recess and a lower enlarged head. A concave metallic socket with a reversed upper lip portion is disposed at the bottom of the recess and the lower end of the crutch bow is engaged with the socket. The lower surface of the head of the tip is generally convex and is formed with a plurality of concentric grooves. The combination of the metal socket with the convex lower surface of the head provides a greater surface area of contact between the tip and the supporting surface during use, thereby achieving greater safety for use of the crutch.

4 Claims, 4 Drawing Figures

CRUTCH TIP CONSTRUCTION

BACKGROUND OF THE INVENTION

Crutches have traditionally included a rubber or resilient tip having an upwardly extending axial recess to receive the lower end of the crutch bow. In use, the tip engages a supporting surface, and being resilient, acts to prevent slippage of the crutch on the surface.

In the past, the lower surface of the crutch tip has been generally concave. In theory, when a load is applied to the crutch, the concave lower surface will deflect to bring the entire lower surface into contact with the supporting surface to obtain a maximum area of surface contact. However, in practice, very rarely is the lower end of the tip positioned flat against the supporting surface when the load is applied, for the tip is usually at an angle to the vertical, with the result that only a small portion of the periphery of the tip actually engages the supporting surface.

In an attempt to more positively direct the load to the entire lower surface of the tip, a metal concave socket has been positioned at the bottom of the recess in the tip and is engaged by the lower end of the crutch bow, as disclosed in U.S. Pat. No. 3,741,226. When a load is applied at a slight angle to the vertical, the socket aids in transmitting the load downwardly into the supporting surface.

SUMMARY OF THE INVENTION

The invention is directed to an improved crutch tip construction. In accordance with the invention, the crutch tip is formed of a resilient or elastomeric material and includes an upper tubular portion or stem having an axial recess and a lower enlarged head. A concave metallic socket is located at the bottom of the recess and the lower end of the crutch bow is adapted to engage the metallic socket.

The lower surface of the head of the tip is generally convex in contour and is provided with a plurality of concentric grooves which define intermediate ribs.

The crutch tip construction of the invention is directly opposed to traditional concepts which utilize a concave bottom surface for the tip. In the invention, the convex lower surface of the tip cooperates with the concave metal socket to place the center of gravity over the part of the tip engaging the supporting surface to thereby provide a greater surface area of contact with the supporting surface and correspondingly providing a greater margin of safety for use of the crutch.

The concentric ribs formed in the bottom of the convex surface of the head tend to deflect under load to increase the surface contact and prevent slippage.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
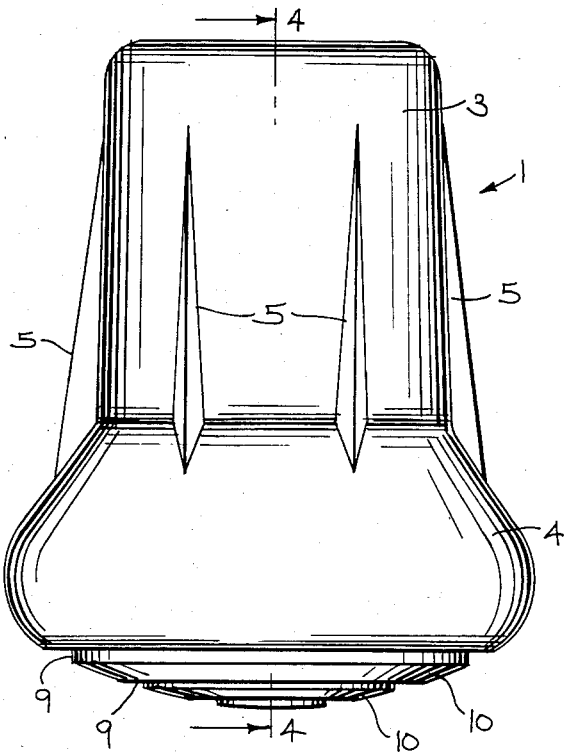
FIG. 1 is a side elevation of the crutch tip of the invention.
Figure 2:
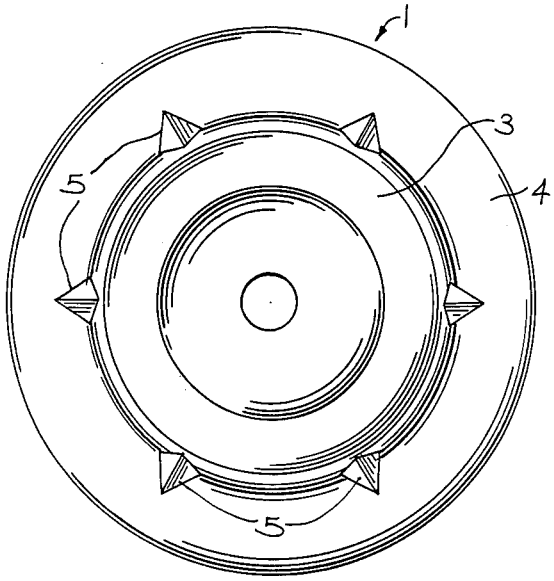
FIG. 2 is a top view of the crutch tip.
Figure 3:
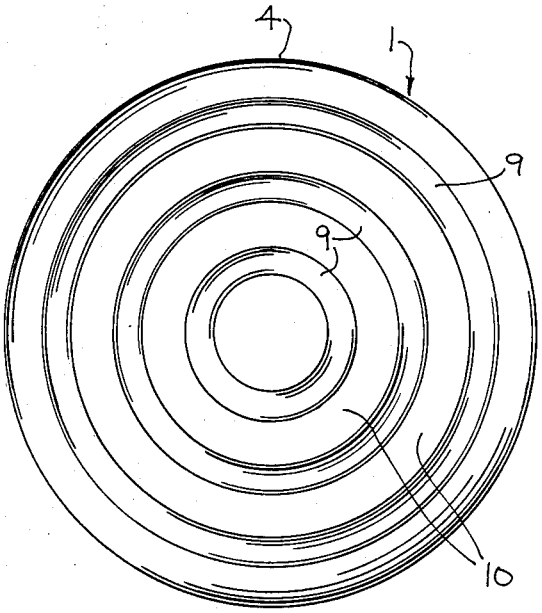
FIG. 3 is a bottom view.

The drawings illustrate an improved crutch tip 1 to be attached to the lower end of a bow 2 of a crutch.

Crutch tip 1 is formed of a flexible resilient material, such as rubber or an elastomeric material and is provided with an upper tubular stem portion 3 and a lower enlarged head 4. A plurality of external ribs 50 connect the head 4 with the stem portion 3 and provide added stiffness for the tip.

Figure 4:
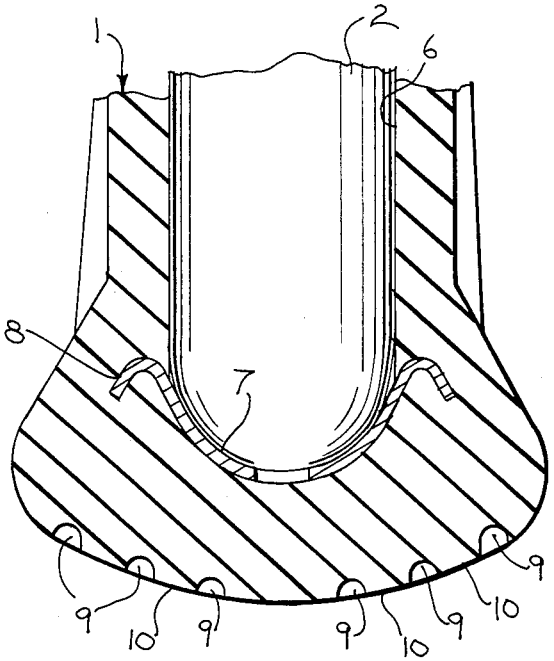
FIG. 4 is a longitudinal section of the crutch tip and taken on line 4—4 of FIG. 1

As best shown in FIG. 4, the stem portion 3 is provided with an axial recess 6 which receives the lower end of bow 2 and a concave metallic socket 7 is mounted in the lower end of recess 6. The periphery of socket 7 is formed with a downwardly extending flange 8 which is embedded within the elastomeric material of tip 1. A socket 7 can be similar to that disclosed in U.S. Pat. No. 3,741,226.

Formed in the lower surface of head 4 is a series of concentric grooves 9 which define intermediate circular ribs 10.

The use of the convex lower surface is a departure from the traditional crutch tip construction which has generally utilized a concave lower surface for the tip. It was believed that when a load was applied to the crutch, the central concavity in the tip would deform downwardly to bring the entire lower surface of the tip into contact with the supporting surface and thereby provide an increased contact area. However, it has been found that in practice, a load is rarely applied to the crutch when the crutch is in a true vertical position, but instead the load is generally applied when the crutch is at an angle to the vertical, so that only a portion of the periphery of the crutch tip would be in contact with the supporting surface.

With the metal socket 7, in combination with the convex lower surface an increased area of contact is achieved between the tip and the supporting surface when the tip is at an angle to the vertical. The socket cooperates with the convex surface to place the center of gravity over the portion of the tip engaging the supporting surface to thereby provide a greater surface area of contact regardless of the angularity of the crutch.

The concentric ribs tend to deflect under load to aid in increasing the surface contact between the tip and the supporting surface and prevent slippage.

Various modes of carrying out the invention are contemplated as being within the scope of the following claims particularly pointing out and distinctly claiming the subject matter which is regarded as the invention.

I claim:

1. A crutch construction, comprising a crutch having a lower end, a resilient tip having an axial recess to receive said lower end, said recess having a bottom, and a concave metallic socket disposed at the bottom of said recess and disposed in engagement with the lower end of said crutch, said tip having an enlarged lower head terminating in a curved convex lower surface adapted to engage a supporting surface during use of said crutch, said lower surface being formed with a plurality of spaced concentric grooves, said concave socket opening upwardly and having its periphery formed with an outwardly and downwardly extending flange which is embedded within the material of said tip, and said lower end of said crutch being convex to fit the concavity of said socket.

2. The construction of claim 1, wherein said tip is formed of an elastomeric material.

3. The construction of claim 1, wherein said tip is formed with an upper tubular section and an enlarged lower head, said lower convex surface disposed on the lower end of said head.

4. The construction of claim 1, wherein the bottom portion of said concave socket has an opening therethrough.

* * * * *

UNITED STATES PATENT AND TRADEMARK OFFICE

CERTIFICATE OF CORRECTION

PATENT NO. : 4,630,626

DATED : December 23, 1986

INVENTOR(S) : TED F. URBAN

It is certified that error appears in the above-identified patent and that said Letters Patent is hereby corrected as shown below:

Col. 2, Line 9, Delete "50" and substitute therefor ---5---

Signed and Sealed this

Fifteenth Day of September, 1987

*Attest:*

DONALD J. QUIGG

*Attesting Officer*

*Commissioner of Patents and Trademarks*